US010799017B2

(12) United States Patent
Kieu

(10) Patent No.: US 10,799,017 B2
(45) Date of Patent: Oct. 13, 2020

(54) MAKEUP APPLICATOR STORAGE SYSTEM

(71) Applicant: James Thao Kieu, San Jose, CA (US)

(72) Inventor: James Thao Kieu, San Jose, CA (US)

( * ) Notice: Subject to any disclaimer, the term of this patent is extended or adjusted under 35 U.S.C. 154(b) by 212 days.

(21) Appl. No.: 16/176,781

(22) Filed: Oct. 31, 2018

(65) Prior Publication Data

US 2020/0128947 A1 Apr. 30, 2020

(51) Int. Cl.

| | |
|---|---|
| ***A46B 15/00*** | (2006.01) |
| ***A46B 5/00*** | (2006.01) |
| ***A46B 9/00*** | (2006.01) |
| ***A45D 40/26*** | (2006.01) |
| ***A46B 17/02*** | (2006.01) |

(52) U.S. Cl.

CPC ..... *A46B 15/0095* (2013.01); *A45D 40/262* (2013.01); *A46B 5/0095* (2013.01); *A46B 9/005* (2013.01); *A46B 15/0091* (2013.01); *A46B 17/02* (2013.01); *A45D 2200/1018* (2013.01); *A46B 2200/1046* (2013.01)

(58) Field of Classification Search

CPC ... A46B 15/0095; A46B 5/0095; A46B 9/005; A46B 5/0091; A46B 17/02; A46B 2200/1046; A45D 40/262; A45D 2200/1018

See application file for complete search history.

(56) References Cited

U.S. PATENT DOCUMENTS

| | | | | |
|---|---|---|---|---|
| 8,060,971 | B1 * | 11/2011 | Castelluccio | A46B 15/0026 15/160 |
| 8,727,141 | B2 * | 5/2014 | Akalin | A47K 1/09 211/66 |
| 9,210,996 | B1 * | 12/2015 | Kramer | A46B 17/02 |
| 9,826,824 | B2 * | 11/2017 | Lim | A46B 17/02 |
| 2003/0000900 | A1 * | 1/2003 | Yu | A46B 5/00 211/65 |
| 2003/0086742 | A1 * | 5/2003 | Gueret | A45D 34/04 401/130 |
| 2003/0133737 | A1 * | 7/2003 | Le Moing | A45D 40/10 401/62 |
| 2005/0156085 | A1 * | 7/2005 | Radovan | B44D 3/123 248/110 |
| 2007/0199575 | A1 * | 8/2007 | Del Ponte | A46B 5/00 132/320 |

(Continued)

*Primary Examiner* — Nicholas D Lucchesi
(74) *Attorney, Agent, or Firm* — Douglas L. Weller

(57) ABSTRACT

A makeup applicator storage system includes a makeup applicator holder that has a first end and a second end. The makeup applicator holder is shaped to hold a makeup applicator at the first end firmly enough that the makeup applicator holder can be used as a handle during makeup application. The makeup applicator holder includes first ferromagnetic material at the second end of the makeup applicator holder. A storage container has a storage lid that includes second ferromagnetic material at an underside of the storage lid. The second ferromagnetic material is oriented at an underside of the storage lid so that the makeup applicator holder can be magnetically attached to the storage lid allowing the makeup applicator, when held by the makeup applicator holder, to be hung from the storage lid when the storage lid is on the storage container and the storage container is oriented so that the storage lid is on a top of the storage container.

10 Claims, 8 Drawing Sheets

(56) References Cited

U.S. PATENT DOCUMENTS

| | | | | |
|---|---|---|---|---|
| 2010/0017990 | A1* | 1/2010 | Piao | A46B 7/023 15/176.6 |
| 2010/0307521 | A1* | 12/2010 | Pires | A45D 33/006 132/200 |
| 2012/0294666 | A1* | 11/2012 | Jang | A45D 34/00 401/126 |
| 2013/0152962 | A1* | 6/2013 | Pires | A45D 33/28 132/313 |
| 2016/0113374 | A1* | 4/2016 | Lim | A45D 33/32 132/288 |
| 2016/0262533 | A1* | 9/2016 | Peters | A46B 17/02 |
| 2017/0265625 | A1* | 9/2017 | Thorpe | A45D 33/006 |
| 2018/0289129 | A1* | 10/2018 | Kosmach | A45D 33/008 |
| 2020/0128939 | A1* | 4/2020 | Kim | A45D 40/00 |

* cited by examiner

MAKEUP APPLICATOR STORAGE SYSTEM

BACKGROUND

From antiquity cosmetics have been used to enhance complexity. Typically today, application of makeup begins with the application of a foundation. Foundation can be applied using a makeup applicator such as fingers, a sponge, a foundation brush or some other type of makeup tool. A sponge is often used as a makeup applicator to create a sheer to medium cover look. A triangular sponge is helpful when blending liquid foundation and concealer. Pointed sponges are good for blending of the eye area. A rounded sponge is often used for powder foundations. A sponge may be washed and dried after use for the purpose of hygiene.

DETAILED DESCRIPTION

FIG. 1, FIG. 2, FIG. 2, FIG. 4 and FIG. 5 show a makeup applicator holder 10 receiving a makeup applicator 11. For example, makeup applicator 11 is composed of a sponge, cloth material, or some other type of flexible material. While makeup applicator 11 is shown having a rounded side and a pointed side, other types of shapes that employ flat or rounded sides, and sharp or rounded edges can be used to implement makeup applicator 11.

Makeup applicator holder 10 is composed of plastic, hard rubber, wood, metal or another type of rigid material. A cloth material may optionally be used to cover part or all of makeup applicator holder 10 A groove 31 can optionally be included in the interior of makeup applicator holder 10 to aid in holding makeup applicator 11 securely within makeup applicator holder 11. While in FIG. 1, FIG. 2, FIG. 2, FIG. 4 and FIG. 5, makeup applicator holder 10 is illustrated with a hollow barrel shape with a circular cross-section, other shapes can be used to implement makeup applicator holder 10. For example the cross-section of makeup applicator holder 10 can be oval, square, rectangular, five-sided, six-sided and so on. In any event, makeup applicator holder 10 is shaped to hold makeup applicator 11 firmly enough that makeup applicator holder 10 can be used as a handle during makeup application.

Figure 1:
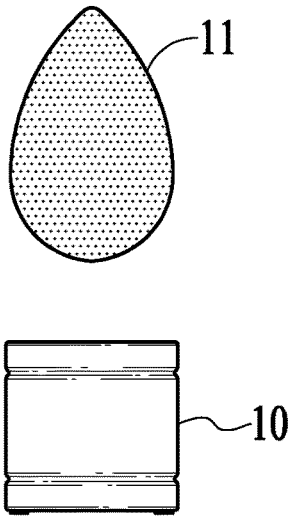
FIG. 1, FIG. 2, FIG. 3, FIG. 4 and FIG. 5 show a makeup applicator holder receiving a makeup applicator in accordance with an implementation.
Figure 2:
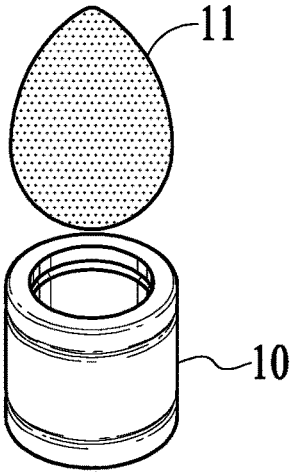
Figure 3:
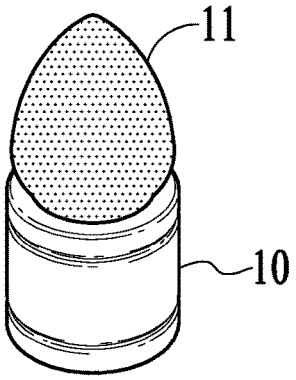
Figure 4:
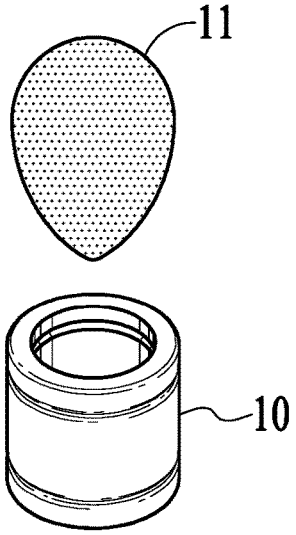
Figure 5:
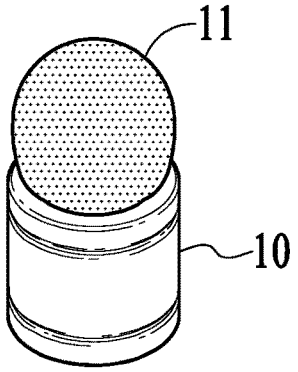
Figure 6:
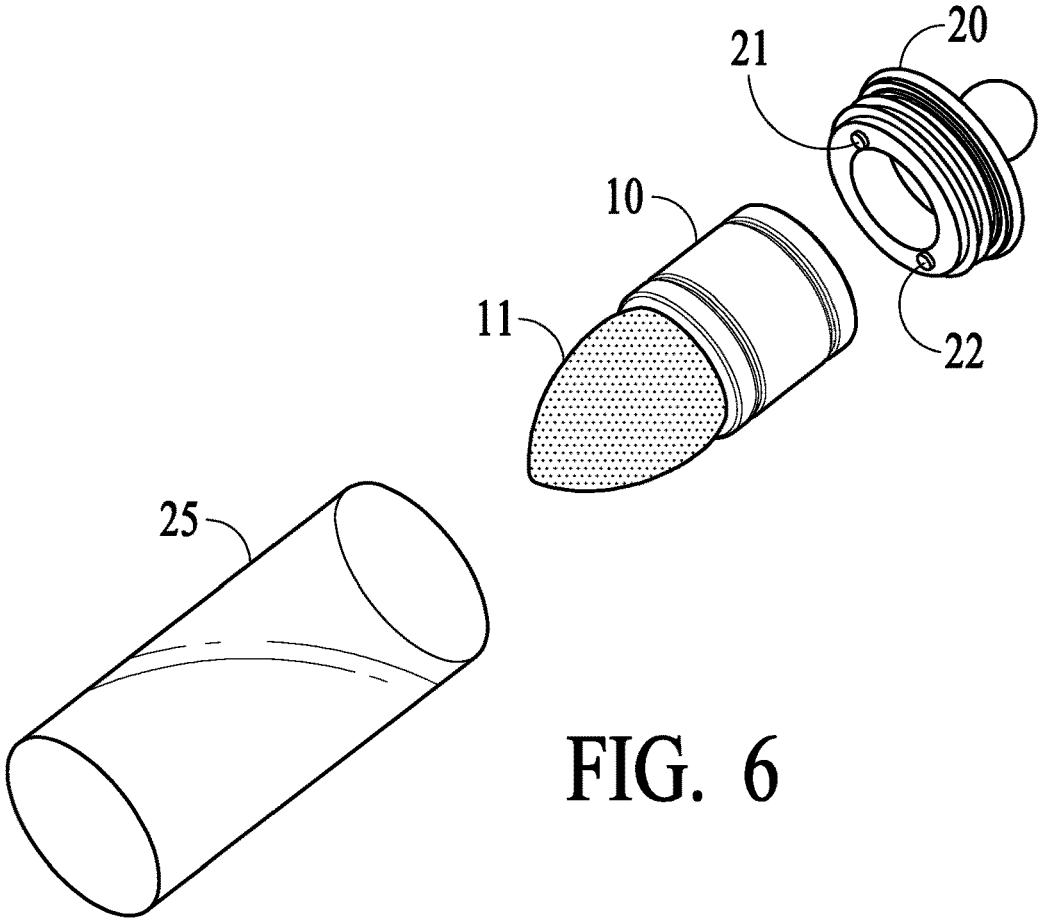
FIG. 6, FIG. 7 and FIG. 8 show a makeup applicator holder used with a storage container in accordance with an implementation.
Figure 7:
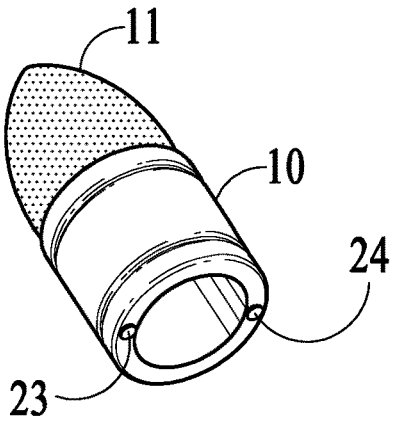
Figure 8:
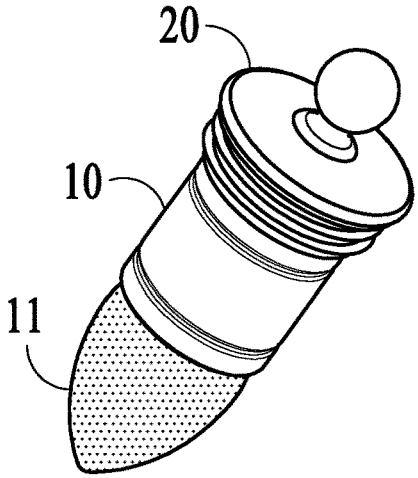
Figure 9:
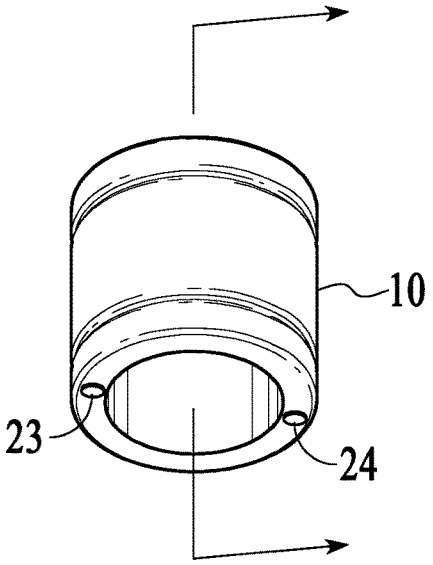
FIG. 9, FIG. 10, FIG. 11, FIG. 12, FIG. 13 and FIG. 14 show various implementations of a makeup applicator holder.

FIG. 6, FIG. 7 and FIG. 8 show makeup applicator holder 10 removeably attached to a storage lid 20 using magnets. For example, storage lid 20 is shown in the shape of a handle. Storage lid 20 includes ferromagnetic material 21 and ferromagnetic material 22 used to attach makeup applicator holder 10 to storage lid 20. Likewise, makeup applicator holder 10 is shown having ferromagnetic material 23 and ferromagnetic material 24 used to attach makeup applicator holder 10 to storage lid 20. Two or more of ferromagnetic material 21, ferromagnetic material 22, ferromagnetic material 23 and ferromagnetic material 24 are magnets. FIG. 6, FIG. 7 and FIG. 8 show storage lid 20 and makeup applicator holder 10 each having two locations where round shape d ferromagnetic material are attached, different numbers, different shapes and different locations can be used, provided the end result is that storage lid 20 is magnetically attached to makeup applicator holder 10.

When makeup applicator 11 is stored within a storage container 25, storage container 25 is oriented so that storage lid 20 is located at the top of storage container 25. Makeup-applicator 11 is held by makeup applicator holder 10 which in turn is held by storage lid 20. The hanging position of makeup applicator 11 promotes drying and cleanliness when makeup applicator 11 is stored within storage container 25. Together, storage container 25, storage lid 20 and makeup applicator holder 10 form a makeup applicator storage system. Additionally, makeup applicator holder 10 can remain holding makeup applicator 11 in order to be used during makeup application.

Figure 10:
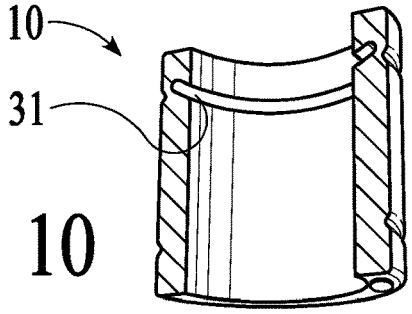
Figure 11:
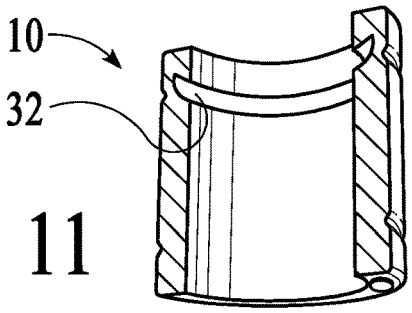
Figure 12:
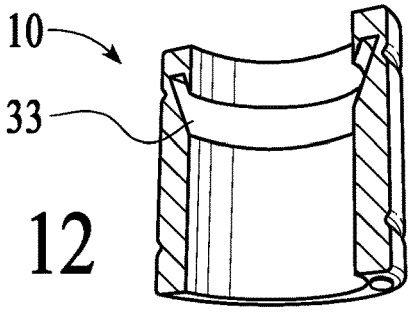
Figure 13:
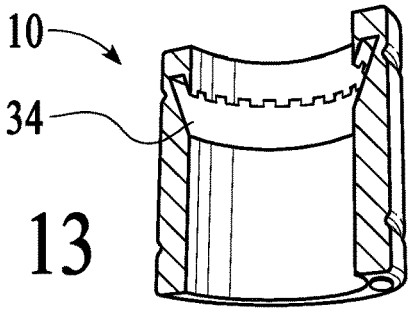
Figure 14:
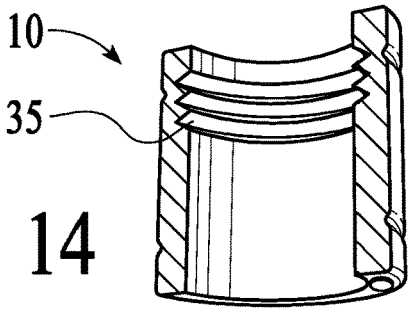

FIG. 9, FIG. 10, FIG. 11, FIG. 12, FIG. 13, FIG. 14, FIG. 15 and FIG. 16 show various implementations of makeup applicator holder 10 with different shaped grooves. For example, FIG. 10 shows makeup applicator holder 10 with a rounded groove 31. FIG. 11 shows makeup applicator holder 10 with a groove with a half circle shape 32. FIG. 12 shows makeup applicator holder 10 with a groove with a sharp ridge 33. FIG. 13 shows makeup applicator holder 10 with a groove with a sharp ridge with teeth 34. FIG. 14 shows makeup applicator holder 10 with multiple grooves 35 separated by sharp ridges. While FIG. 14 show multiple groves 35 having sharp ridges without teeth, teeth could be included in some or all of the sharp ridges formed by multiple groves 35.

Figure 15:
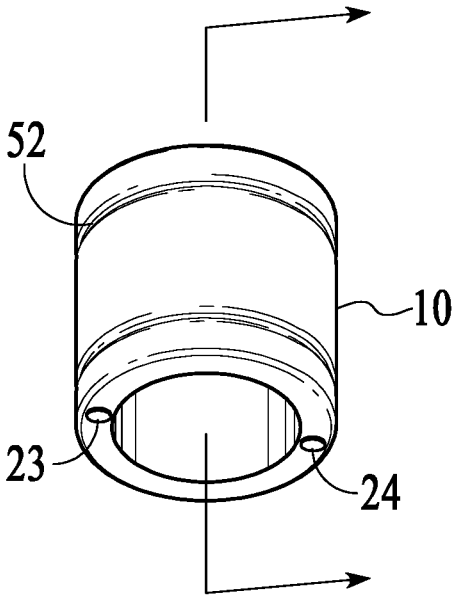
FIG. 15 and FIG. 16 show a makeup applicator holder implemented with cloth material over a rigid structure material in accordance with an implementation.
Figure 16:
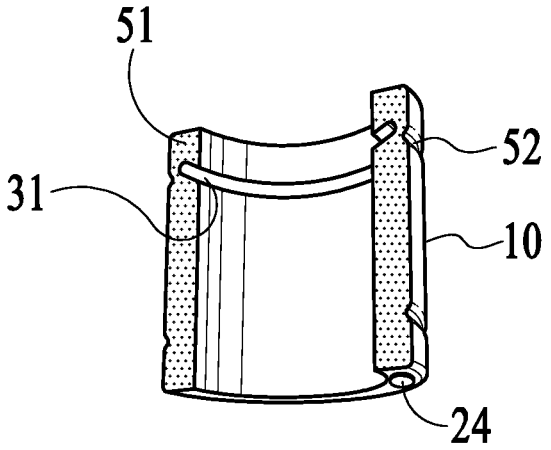

FIG. 15 and FIG. 16 show makeup applicator holder 10 implemented with cloth material 52 over a rigid structure material 51.

Figure 17:
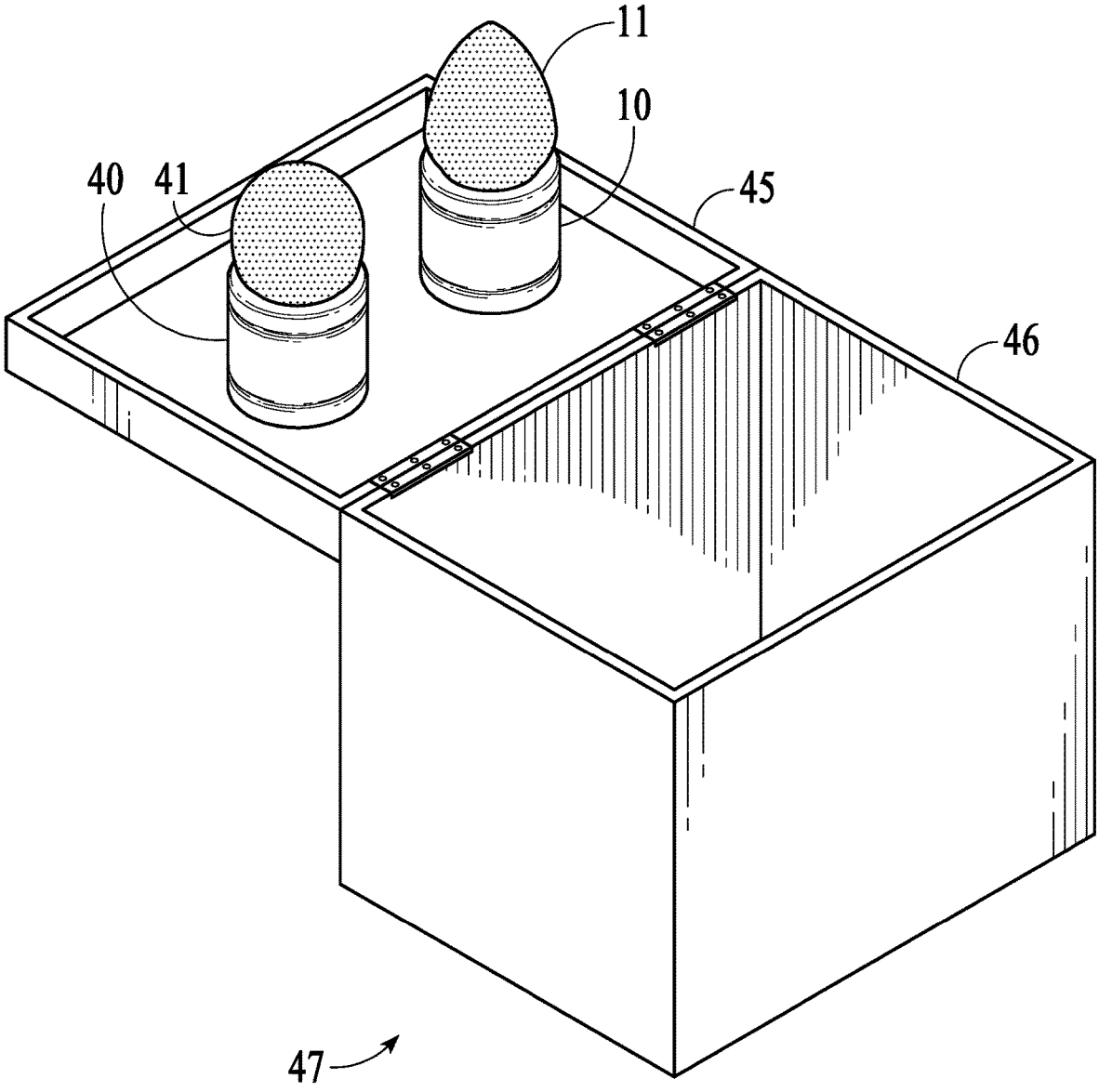
FIG. 17, FIG. 18, FIG. 19 and FIG. 20 illustrate various implementations of makeup applicator holders attached to a storage box.
Figure 18:
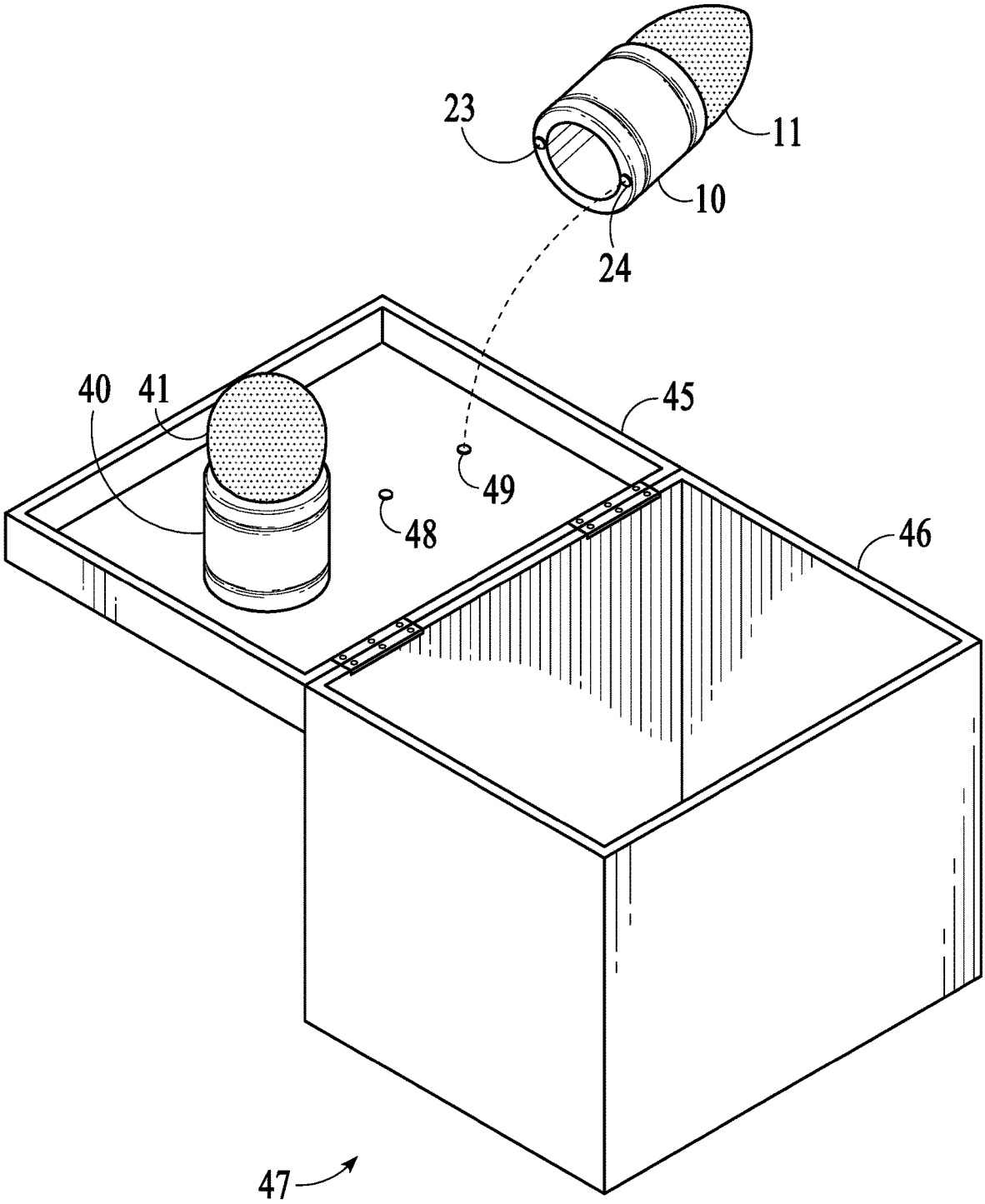
Figure 19:
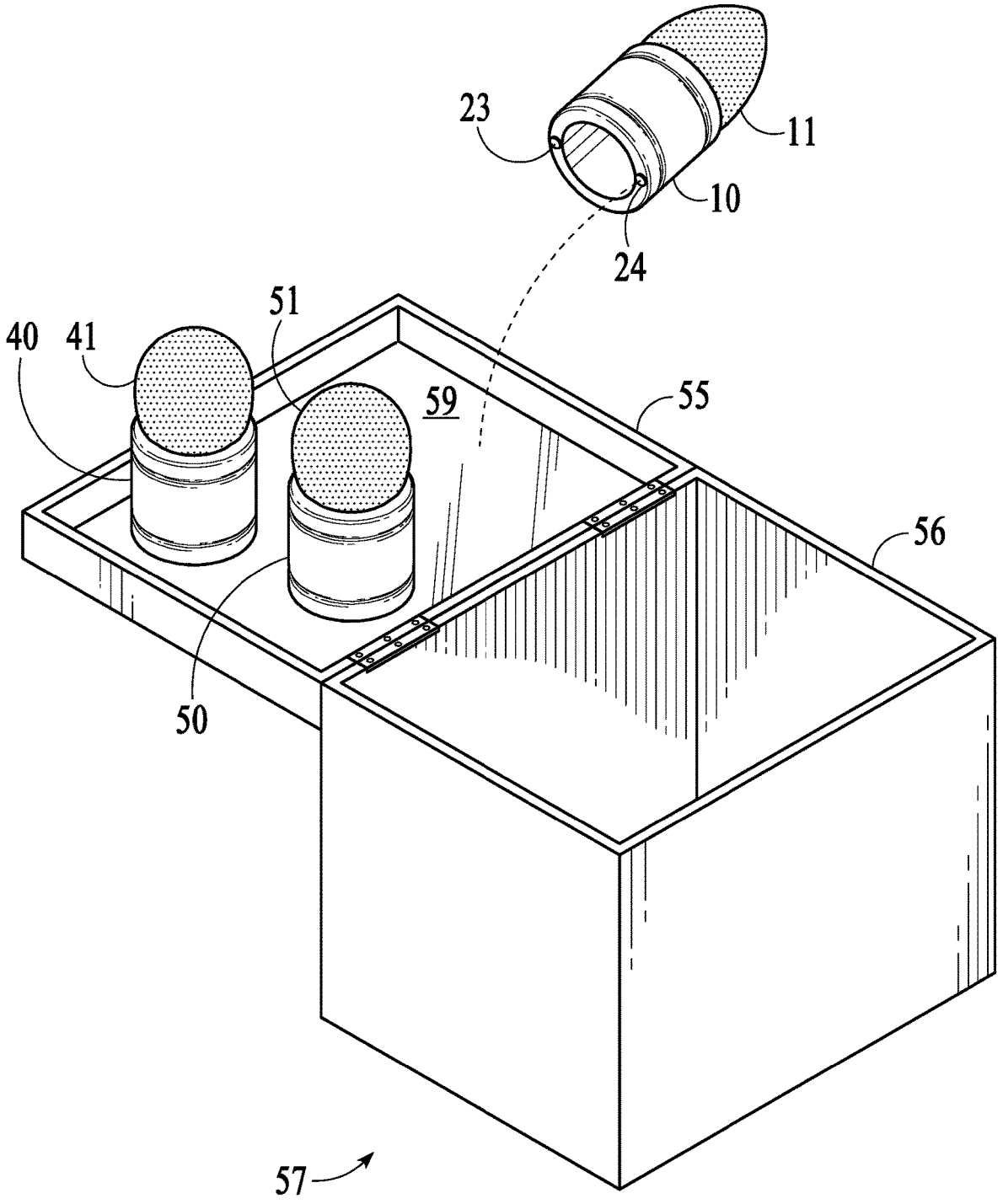

FIG. 17, FIG. 18 and FIG. 19 illustrate various implementations of makeup applicator holders attached to a storage box.

FIG. 17 shows makeup applicator holder 10 holding makeup applicator 11 attached magnetically to a storage lid 45 of a storage container 47 having a main body 46. A makeup applicator holder 40 holding a makeup applicator 41 is also shown attached magnetically to storage lid 45.

FIG. 18 shows makeup applicator holder 10 and makeup applicator 11 removed from storage lid 45 to reveal ferromagnetic material 48 and ferromagnetic material 49 on the underside of storage lid 45. Two or more of ferromagnetic material 48, ferromagnetic material 49, ferromagnetic material 23 and ferromagnetic material 24 are magnets. FIG. 18 show storage lid 45 and makeup applicator holder 10 each having two locations where round shaped ferromagnetic material are attached, different numbers, different shapes and different locations can be used, provided the end result is that storage lid 45 is attached to makeup applicator holder 10 magnetically.

For example, FIG. 19 shows makeup applicator holder 40 holding makeup applicator 40 attached magnetically to a sheet of ferromagnetic material 59 on the underside of a storage lid 55 of a storage container 57 having a main body 56. A makeup applicator holder 50 holding a makeup applicator 51 is also shown attached magnetically to the sheet of ferromagnetic material 59 of storage lid 55. Makeup applicator holder 10 and makeup applicator 11 are shown removed from storage lid 55 to illustrate ferromagnetic material 23 and ferromagnetic material 24 are used to attach makeup applicator holder 10 to the sheet of ferromagnetic material 59.

Figure 20:
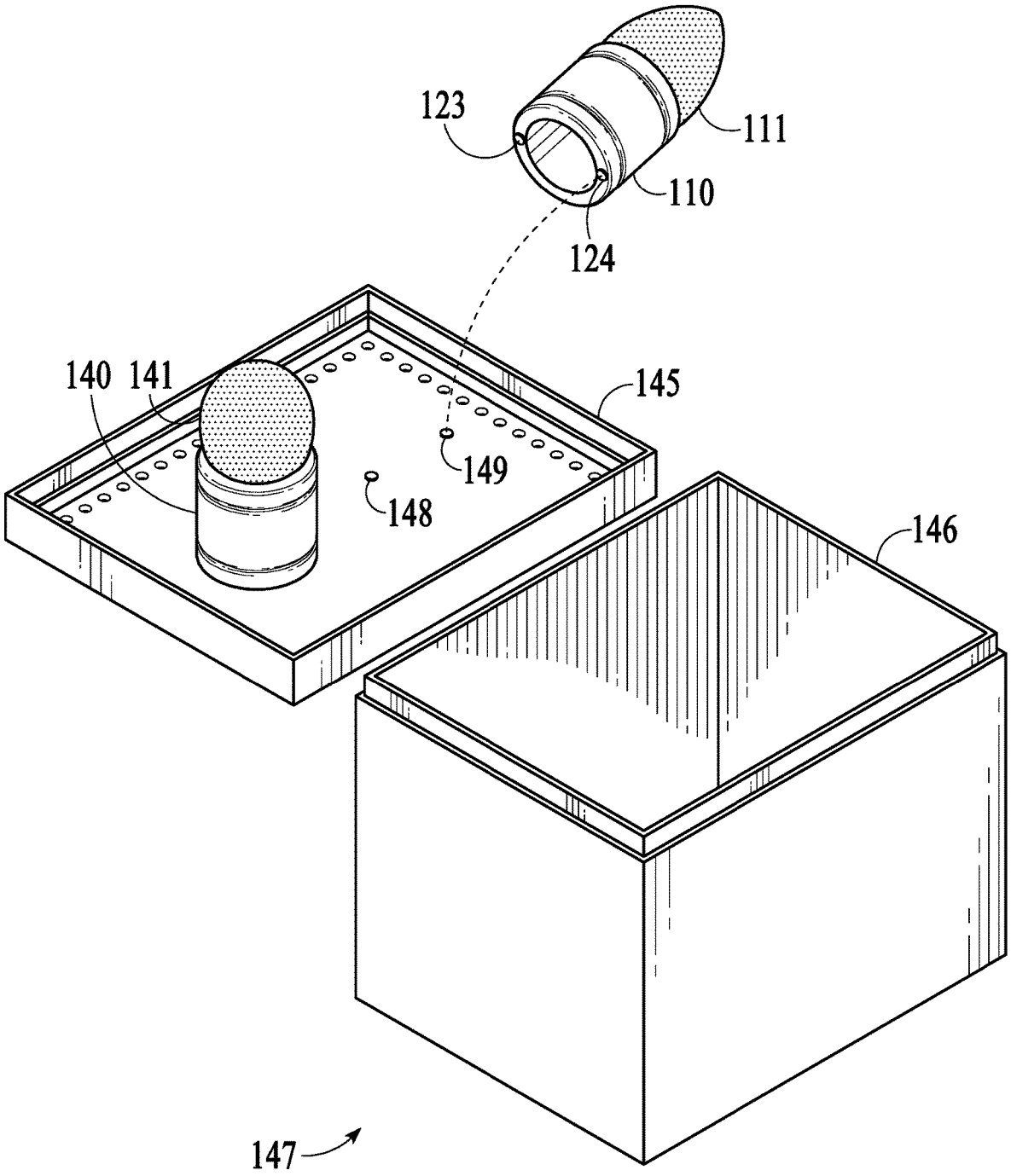

FIG. 20 shows a makeup applicator holder 140 holding a makeup applicator 141 attached magnetically to a storage lid 145 of a storage container 147 having a main body 146. A makeup applicator holder 110 and makeup applicator 111 are show removed from storage lid 145 to reveal ferromagnetic material 148 and ferromagnetic material 149 on the underside of storage lid 145. Two or more of ferromagnetic material 148, ferromagnetic material 149 are magnets. FIG. 20 show storage lid 145 and makeup applicator holder 110 each having two locations where round shaped ferromagnetic material are attached, different numbers, different shapes and different locations can be used, provided the end result is that storage lid 145 is attached to makeup applicator holder 110 magnetically. With storage lid 145 are shown air holes placed to allow air to flow into storage lid 145 when closed to help dry out and keep dry makeup applicator 111 and makeup applicator 141 when stored within storage container 147.

Although the present invention has been described in accordance with the embodiments shown, one of ordinary skill in the art will readily recognize that there could be variations to the embodiments, and those variations would be within the spirit and scope of the present invention. Accordingly, many modifications may be made by one of ordinary skill in the art without departing from the spirit and scope of the appended claims.

What is claimed is:

1. A makeup applicator storage system, comprising:

a makeup applicator holder having a first end and a second end, the makeup applicator holder being shaped to hold a makeup applicator at the first end firmly enough that the makeup applicator holder can be used as a handle during makeup application, the makeup applicator holder including first ferromagnetic material at the second end of the makeup applicator holder;

a storage container; and, a storage lid for the storage container, the storage container including second ferromagnetic material at an underside of the storage lid, the second ferromagnetic material oriented at an underside of the storage lid so that the makeup applicator holder can be magnetically attached to the storage lid allowing the makeup applicator, when held by the makeup applicator holder, to be hung from the storage lid when the storage lid is on the storage container and the storage container is oriented so that the storage lid is on a top of the storage container.

2. A makeup applicator storage system as in claim 1, wherein the makeup applicator is in the shape of a tube.

3. A makeup applicator storage system as in claim 1, wherein the makeup applicator comprises a tube that includes a groove on an inner wall of the tube, the groove being situated near the first end so that the groove helps secure the makeup applicator within the tube when the makeup applicator holder holds the makeup applicator.

4. A makeup applicator storage system as in claim 1, wherein the makeup applicator comprises a tube that includes a groove on an inner wall of the tube, the groove being situated near the first end so that the groove helps secure the makeup applicator within the tube when the makeup applicator holder holds the makeup applicator;

wherein the groove has a rounded shape.

5. A makeup applicator storage system as in claim 1, wherein the makeup applicator comprises a tube that includes a groove on an inner wall of the tube, the groove being situated near the first end so that the groove helps secure the makeup applicator within the tube when the makeup applicator holder holds the makeup applicator;

wherein the groove has a half circle shape.

6. A makeup applicator storage system as in claim 1, wherein the makeup applicator comprises a tube that includes a groove on an inner wall of the tube, the groove being situated near the first end so that the groove helps secure the makeup applicator within the tube when the makeup applicator holder holds the makeup applicator;

wherein the groove has a sharp ridge.

7. A makeup applicator storage system as in claim 1, wherein the makeup applicator comprises a tube that includes a groove on an inner wall of the tube, the groove being situated near the first end so that the groove helps secure the makeup applicator within the tube when the makeup applicator holder holds the makeup applicator;

wherein the groove has a sharp ridge with teeth.

8. A makeup applicator storage system as in claim 1, wherein the makeup applicator comprises a tube that includes a plurality of grooves separated by sharp ridges on an inner wall of the tube, the plurality of grooves being situated near the first end so that the plurality of grooves helps secure the makeup applicator within the tube when the makeup applicator holder holds the makeup applicator.

9. A makeup applicator storage system as in claim 1:

wherein the storage container is sufficiently large to hold at least one additional makeup applicator; and, wherein the second ferromagnetic material is arranged so that at least one additional makeup applicator holder can be magnetically attached to the storage lid allowing at least one additional makeup applicator, when held by the at least one additional makeup applicator holder, to be hung from the storage lid when the storage lid is on the storage container and the storage container is oriented so that the storage lid is on the top of the storage container.

10. A makeup applicator storage system as in claim 1, wherein the first ferro magnetic material comprises two pieces of ferro magnetic material and the second ferro magnetic material comprises two pieces of ferro magnetic material.

* * * * *